US008347412B2

(12) United States Patent
Clement

(10) Patent No.: US 8,347,412 B2
(45) Date of Patent: Jan. 8, 2013

(54) ATHLETIC PANTS

(75) Inventor: Adam Clement, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 355 days.

(21) Appl. No.: 12/348,673

(22) Filed: Jan. 5, 2009

(65) Prior Publication Data

US 2009/0172859 A1 Jul. 9, 2009

Related U.S. Application Data

(60) Provisional application No. 61/019,050, filed on Jan. 4, 2008.

(51) Int. Cl.
*A41D 13/00* (2006.01)

(52) U.S. Cl. ..... 2/22; 2/23; 2/24; 2/62; 2/227; 2/69

(58) Field of Classification Search ..... 2/22, 23, 2/24, 62, 227, 239, 242, 69
See application file for complete search history.

(56) References Cited

U.S. PATENT DOCUMENTS

| | | | | |
|---|---|---|---|---|
| 2,716,754 | A * | 9/1955 | Hirsch | 2/227 |
| 4,987,613 | A * | 1/1991 | Loverdi et al. | 2/23 |
| 6,119,274 | A * | 9/2000 | Graham | 2/242 |
| 6,279,161 | B1 * | 8/2001 | Johnston | 2/69 |
| 7,237,270 | B2 * | 7/2007 | Crye et al. | 2/24 |
| 2002/0138893 | A1 * | 10/2002 | Culhane | 2/79 |
| 2004/0078865 | A1 * | 4/2004 | Culhane | 2/69 |
| 2006/0282938 | A1 * | 12/2006 | Jewell et al. | 2/227 |
| 2007/0028362 | A1 * | 2/2007 | Cash, Jr. | 2/227 |

* cited by examiner

*Primary Examiner* — Alissa Tompkins
(74) *Attorney, Agent, or Firm* — Maginot, Moore & Beck

(57) ABSTRACT

A pair of athletic pants comprises a hip portion, and two leg portions extending from the hip portion. Each leg portion includes a knee portion configured to be worn over the knee of a human, the knee portion comprised of a first material. A slit is formed in each knee portion and a second material provided in each slit, wherein the second material has greater elasticity than the first material in at least two different directions. In at least one embodiment, each slit in the knee portion is in the shape of a lens. In at least one other embodiment, each slit in the knee portion is in the shape of a symmetric lens. In at least one embodiment, the athletic pants are baseball pants.

19 Claims, 8 Drawing Sheets

ATHLETIC PANTS

CROSS-REFERENCE TO RELATED APPLICATIONS

This application claims priority from U.S. Patent Application No. 61/019,050, filed Jan. 4, 2008, the contents of which are incorporated herein by reference.

FIELD

The present disclosure relates to the field of athletic apparel, and more particularly to athletic pants.

BACKGROUND

Those participating in sporting events often wear specific garments. For example, a specific jersey may be worn on the torso and a matching set of pants may be worn on the legs. It is typically desirable for these garments to assist the player in the sporting activity and/or make the player's activities as comfortable as possible.

In the sport of baseball, players typically wear a pair of pants comprised of a relatively stiff polyester or other durable material. Durable materials are desired, as baseball players often slide into a base, dive after a ball, or otherwise end upon on the ground during play. However, the durable material typically used for baseball pants is limited in its ability to stretch and flex. Thus, baseball players often find the material used for baseball pants to be non-flexible, binding, hot and/or generally uncomfortable.

The stiff and non-flexible quality of baseball pants is often most evident at a player's knees. In particular, significant bending of the knees may occur when a player runs, slides, or crouches down (such as a catcher crouching behind home plate). Accordingly, it would be desirable to provide a baseball pant that is durable, yet provides flex and stretch for the player, particularly at the player's knees.

SUMMARY

Disclosed is a pair of athletic pants comprising a hip portion, and two leg portions extending from the hip portion. Each leg portion includes a knee portion configured to be worn over the knee of a human, the knee portion comprised of a first material. A slit or other opening is formed in each knee portion and a second material provided in each slit, wherein the second material has greater elasticity than the first material. In at least one embodiment, each slit in the knee portion is in the shape of a lens. In at least one other embodiment, each slit in the knee portion is in the shape of a symmetric lens.

In at least one embodiment, the athletic pants are baseball pants comprising a waistband, a hip portion, and two leg portions extending from the hip portion. Each leg portion includes a front panel comprised of a first material and a rear panel comprised of the first material, the front panel and the rear panel being joined together along a left seam and a right seam. A knee slit is formed in the front panel, the knee slit elongated in the horizontal direction and extending from the left seam to the right seam with a second material provided in the knee slit, the second material having a greater elasticity than the first material. In at least one embodiment, the second material is designed to stretch substantially more than the first material in both a horizontal and a vertical direction. A tapered end is provided at the distal end of each leg portion.

In at least one additional embodiment, the athletic pants comprise a main body portion comprised of a first material.

The main body portion includes a hip portion, a first leg extending from the hip portion and a second leg extending from the hip portion. At least one opening is formed in the main body with a second material provided in the opening. The second material is different from the first material and has a substantially greater elasticity than the first material. The opening may be provided as a horizontal slit in a knee portion of the main body. Alternatively or in addition, the opening may be provided as a vertical slit extending along a vastus lateralis portion of the pants.

The above described features and advantages, as well as others, will become more readily apparent to those of ordinary skill in the art by reference to the following detailed description and accompanying drawings. While it would be desirable to provide athletic pants that provide one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

DESCRIPTION

Figure 1:
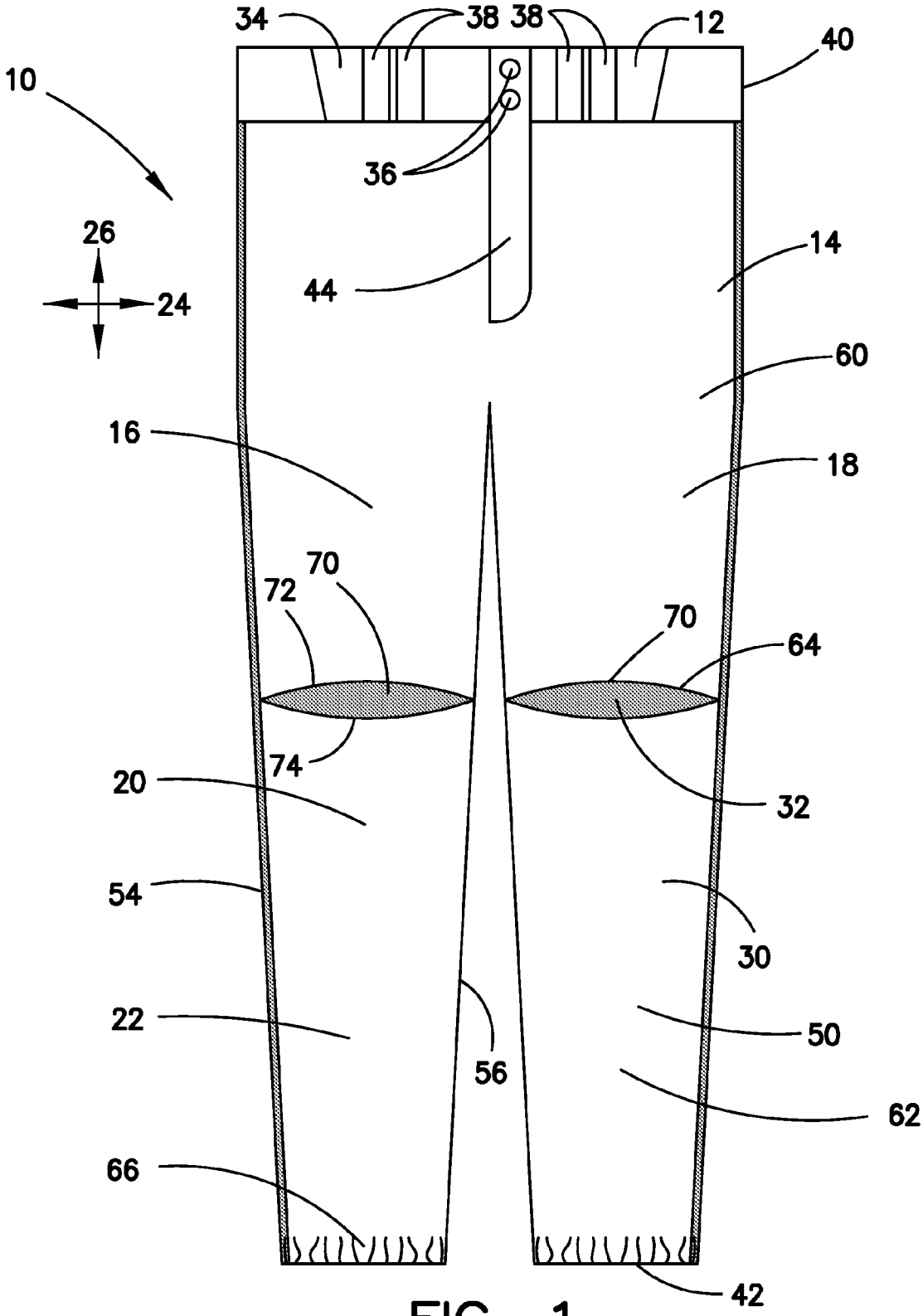
FIG. 1 shows a front view of a pair of athletic pants.

With reference to FIGS. 1-4, a pair of athletic pants 10 is shown. In the disclosed embodiment, the athletic pants are baseball pants comprising a main body including a hip portion 14, and two leg portions 16, 18 extending from the hip portion 14. The pants also include a waist portion 12 connected main body of the pants 10 at the top of the hip portion. The main body of the pants 10 also generally includes a front portion 20 shown in FIG. 1 and a rear portion 22 shown in FIG. 3. Each of the hip portion 14, first leg portion 16 and second leg portion 18 include portions found on the front portion and back portion of the pants.

The pants 10 are mostly comprised of a first fabric material 30, such as a relatively stiff double-knit 100% polyester material as is commonly used for baseball pants. The first fabric material 30 is generally heavy, but durable. The first material 30 exhibits some elasticity by its ability to stretch to a limited degree and then recover its size and shape. This elasticity may be seen by stretching the first material 30 in different directions, such as the latitudinal or longitudinal directions 24 and 26 shown in FIG. 1. While the first fabric material 30 does exhibit some elasticity, the elasticity of the material is relatively small, as is common with the traditional material provided for baseball pants. This relatively small elasticity may be attributed to the polyester fabric's "mechanical" ability to stretch, which is usually in one direction (i.e. latitudinal or longitudinal directions), and is determined by the way in which the fabric is constructed (i.e., the way in which the fabric is knitted). Accordingly, this first material contains no elastomeric fibers or contains a small percentage of elastomeric fibers (e.g., 5% or less).

The waist portion 12 of the pants is provided at an upper or proximal end 40 of the pants. The waist portion 12 includes an elastic waist band 34 and fasteners 36 in the form of snaps used to join the two ends of the waist band 34. Belt loops 38 are also provided on the waist portion 12 to allow the user of the pants 10 to wear a belt.

The hip portion 14 of the main body of the pants is provided below the waist portion 12. The hip portion 14 includes a fly 44 with a zipper or other fastening means behind the fly in the front portion 20 of the pants. Pockets 48 are provided in the back portion 22 of the pants.

The two legs 16, 18 of the main body of the pants extend from the hip portion 14. Each leg 16, 18 includes a front fabric panel 50 and a rear fabric panel 52. The two fabric panels 50, 52 are joined at their sides along opposing longitudinal seams 54, 56. Decorative features, such as a strip of differently colored material may be included along the opposing longitudinal seams 54, 56 for aesthetic purposes.

Each leg 16, 18 includes an upper leg portion 60, a lower leg portion 62, and a knee portion 64 provided between the upper leg portion and the lower leg portion 62. The upper leg portion 60 generally covers the user's thigh, the knee portion 64 generally covers the user's knee within a knee articulation zone, and the lower leg portion 62 generally covers the user's calf. An elastic leg end 66 is provided at the distal end 42 of each leg 16, 18 to hold the fabric on the leg closely against the user.

A slit or other opening 70 is formed in the main body of the pants. In the embodiment of FIGS. 1-4, the opening is provided as a slit in each knee portion 64. In particular, the slit 70 is a long narrow opening in the horizontal direction and extends from the first longitudinal seam 54 to the second longitudinal seam 56. The slit 70 in FIGS. 1-4 is formed in the shape of a lens, including an upper arched portion 72 and a lower arched portion 74. The ends of the upper arched portion 72 and the lower arched portion 74 meet at the longitudinal seams 54, 56. In at least one related embodiment, the slit 70 is provided in the shape of a symmetric lens.

Figure 2:
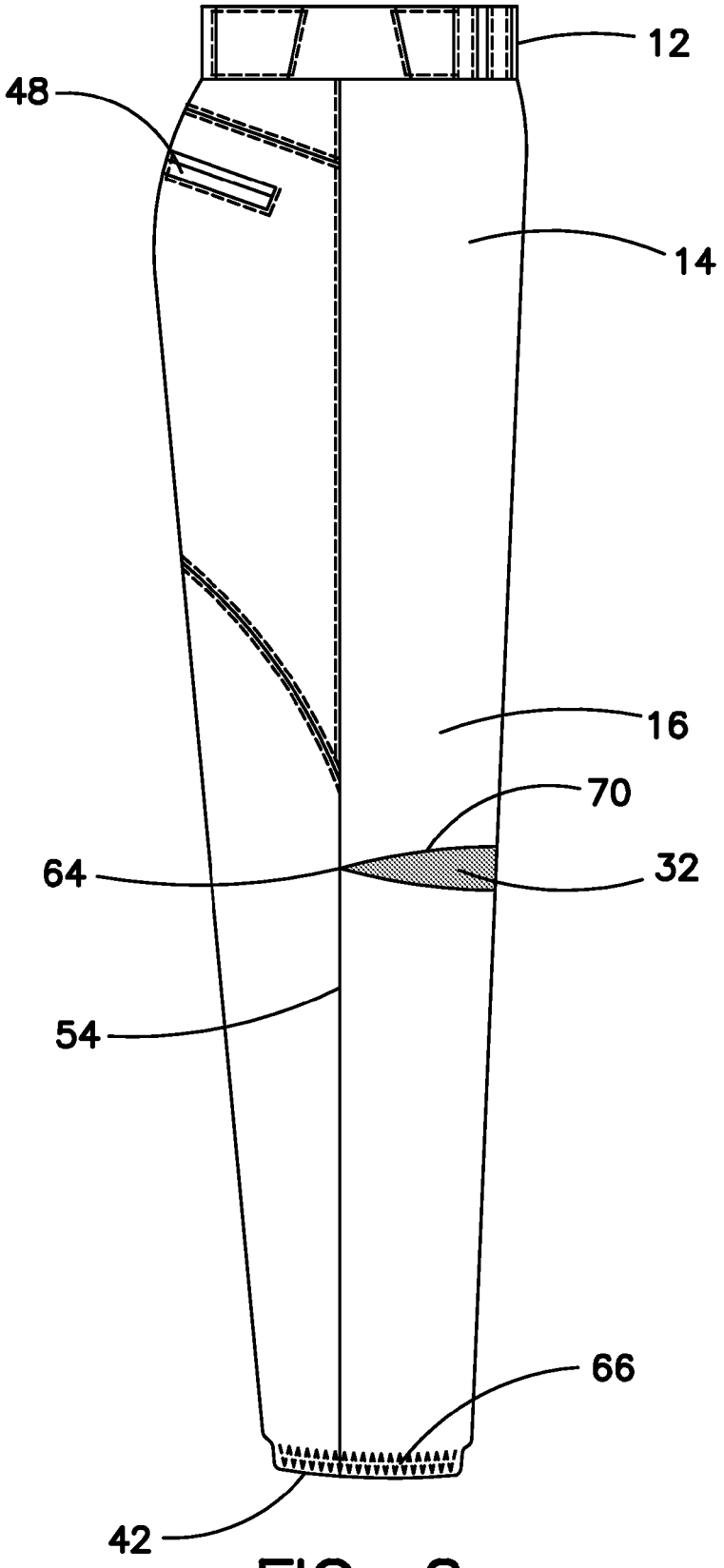
FIG. 2 shows a side view of the athletic pants of FIG. 1.
Figure 3:
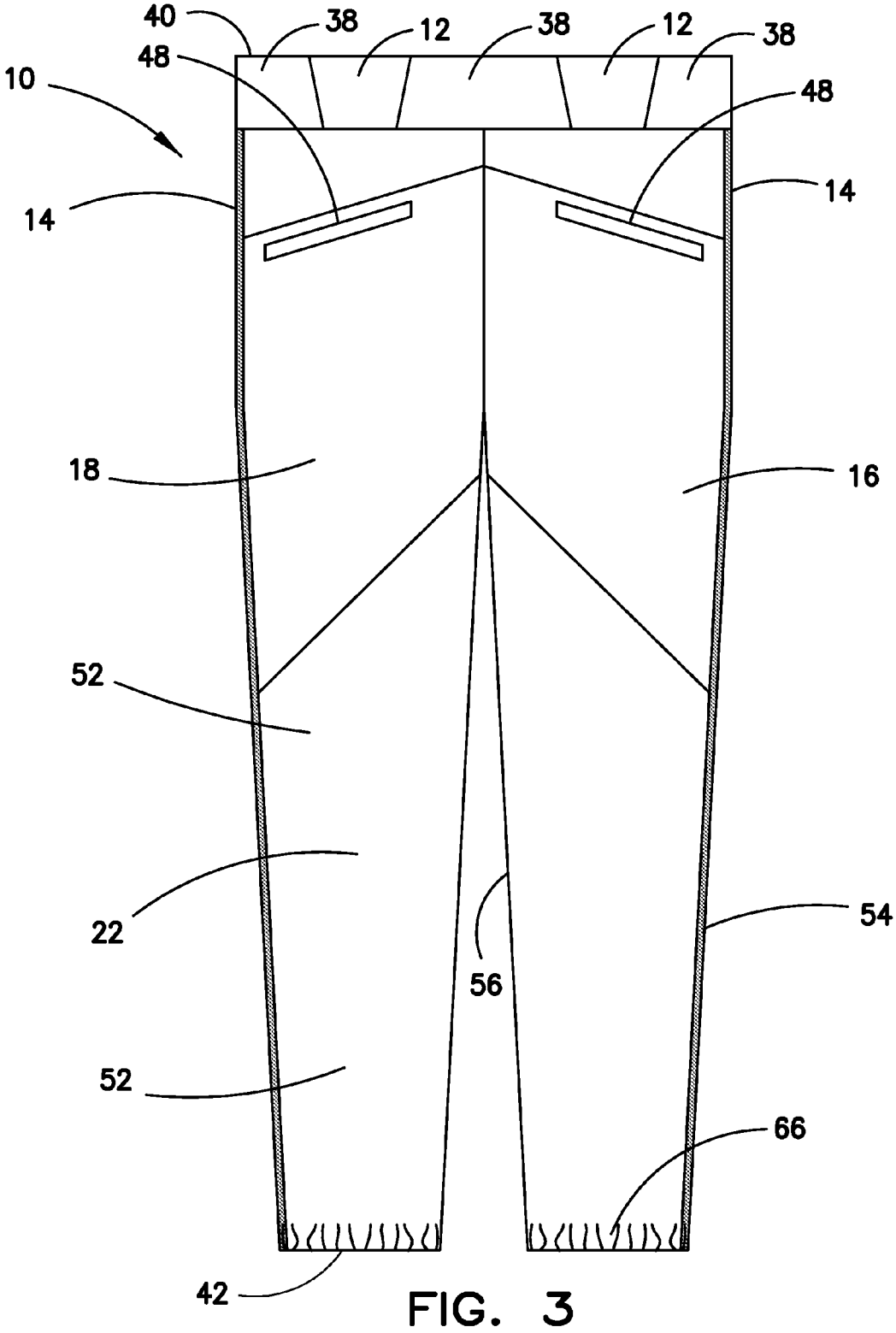
FIG. 3 shows a rear view of the athletic pants of FIG. 1.
Figure 4:
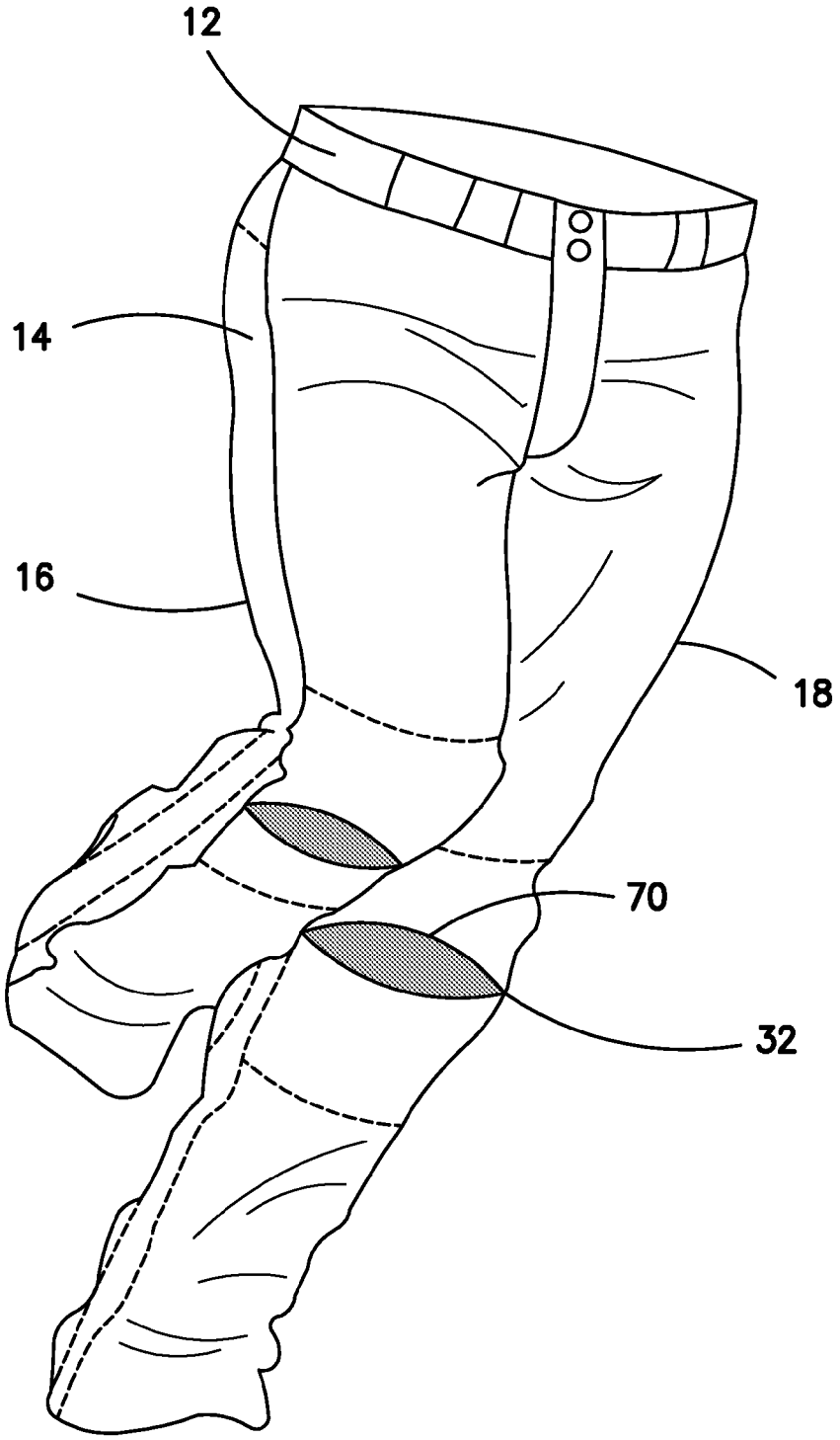
FIG. 4 shows a perspective view of the athletic pants of FIG. 1.
Figure 5:
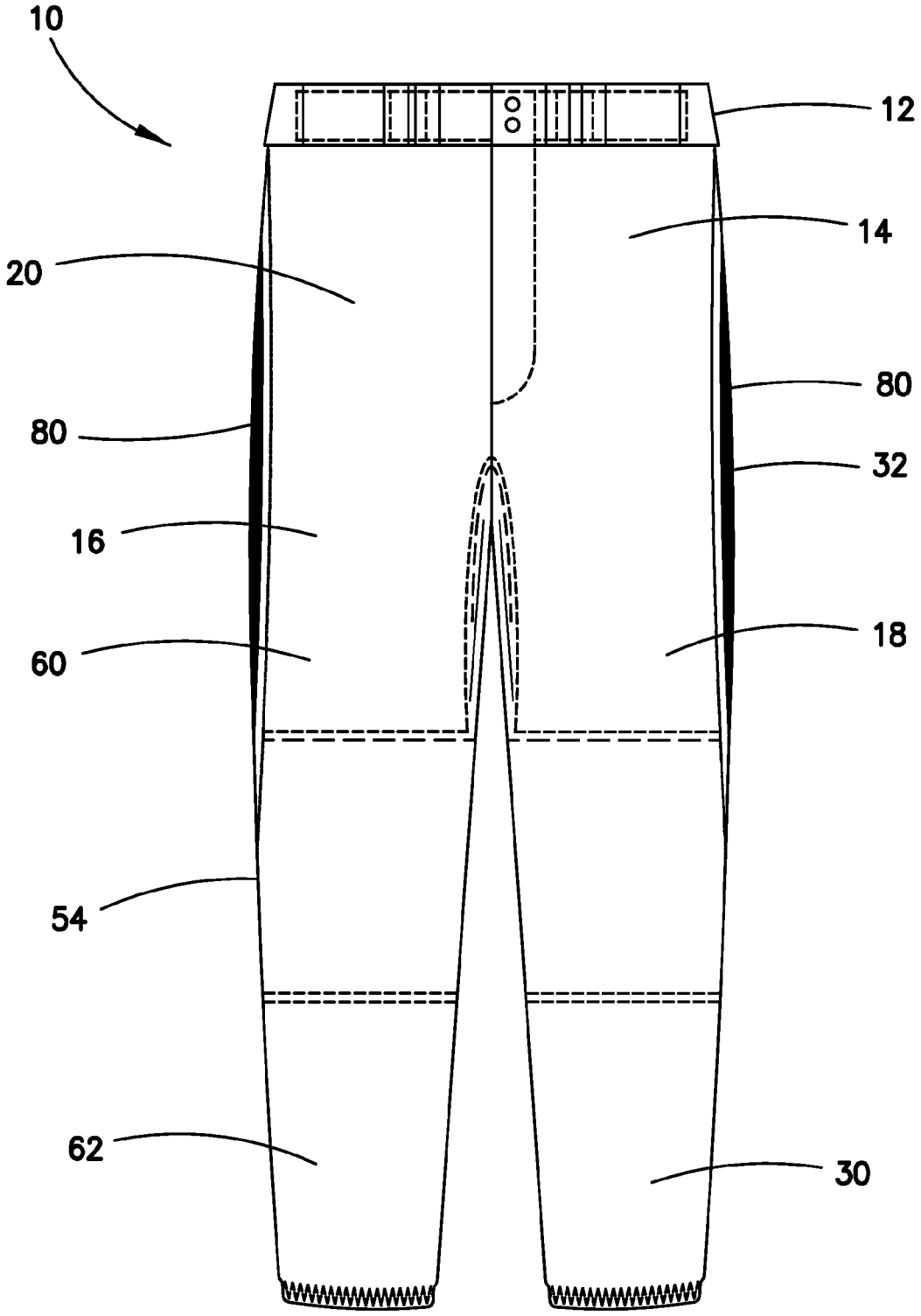
FIG. 5 shows a front view of an alternative embodiment of the athletic pants of FIG. 1.
Figure 6:
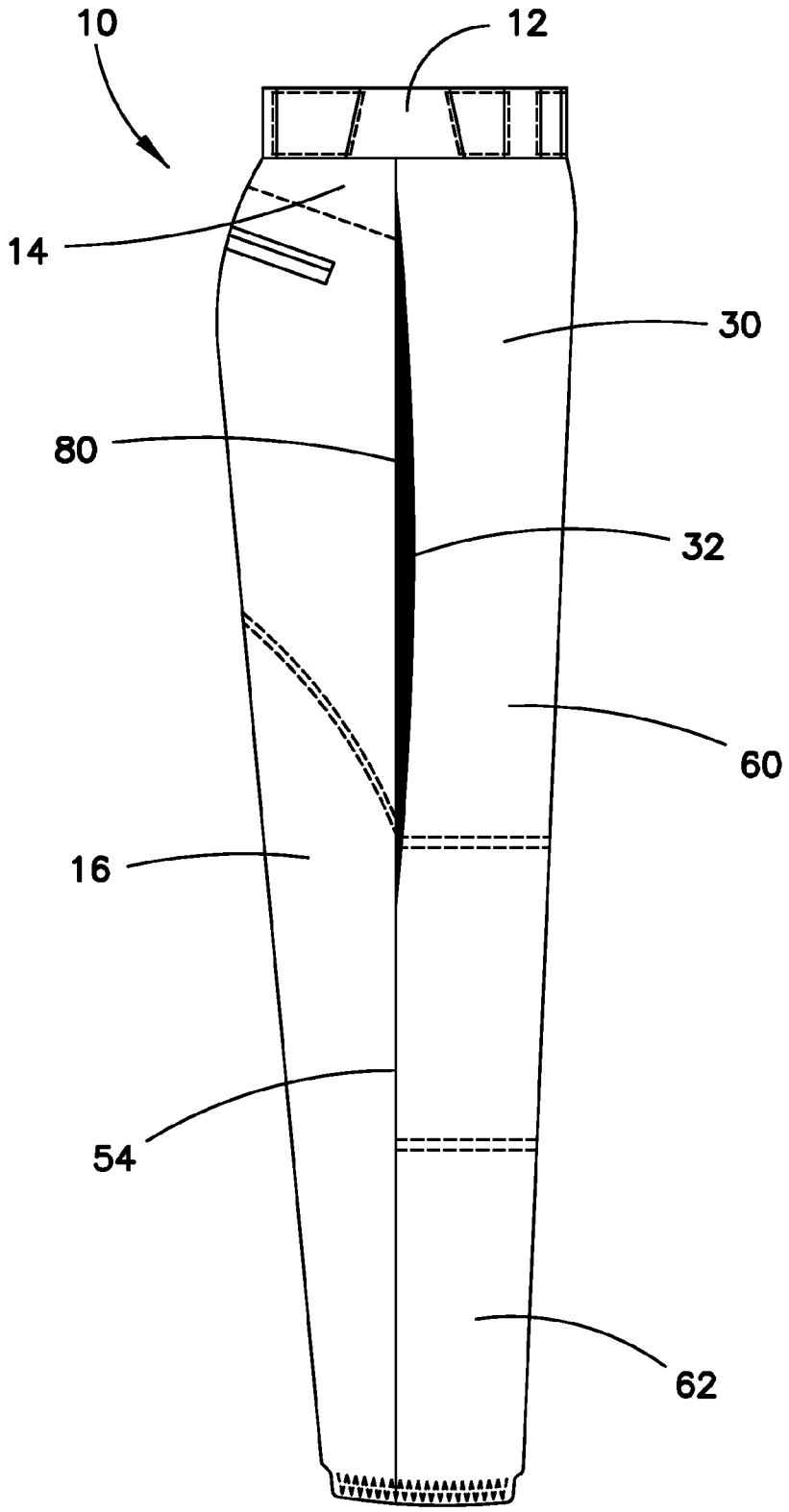
FIG. 6 shows a side view of the athletic pants of FIG. 5.
Figure 7:
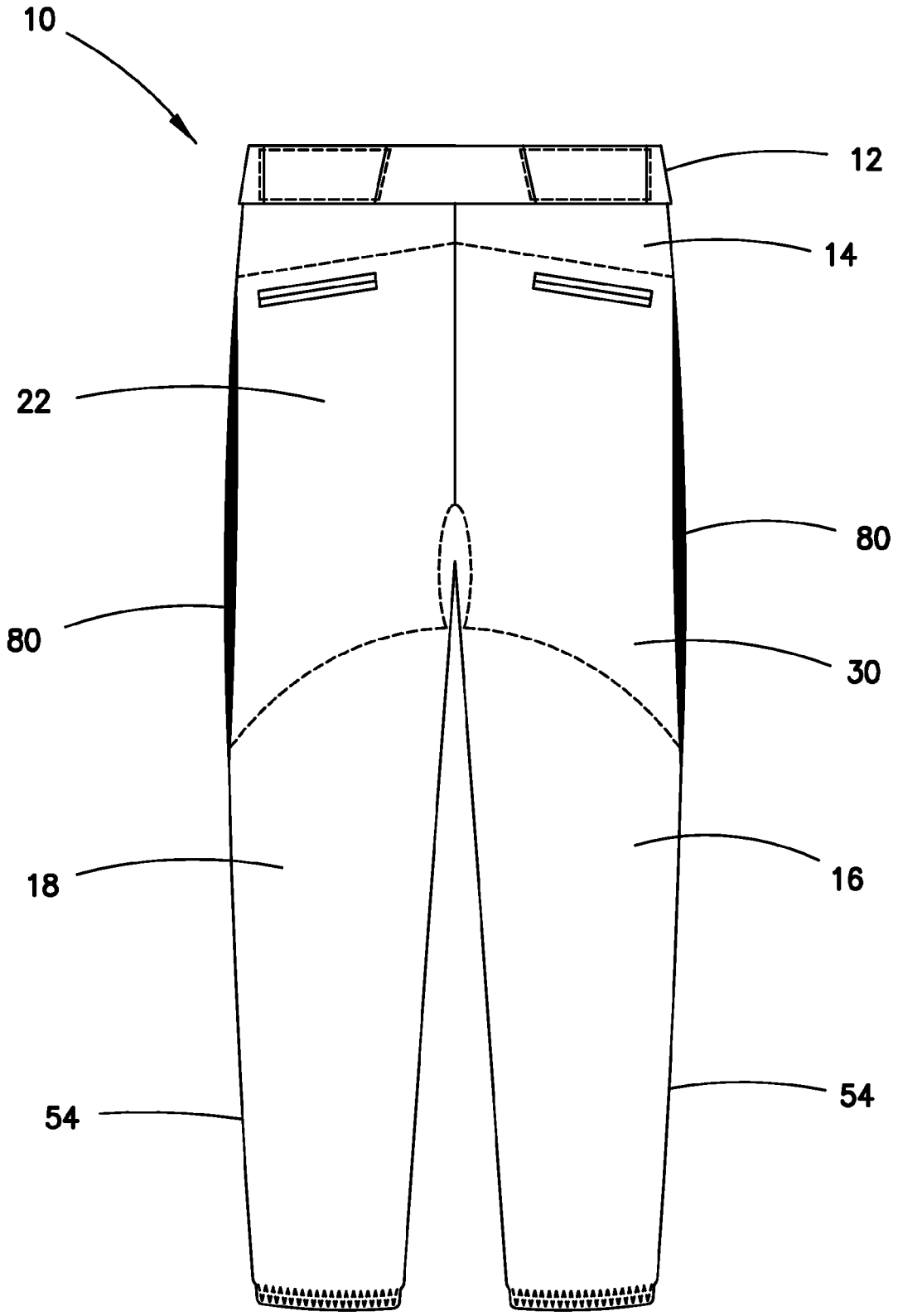
FIG. 7 shows a rear view of the athletic pants of FIG. 5.
Figure 8:
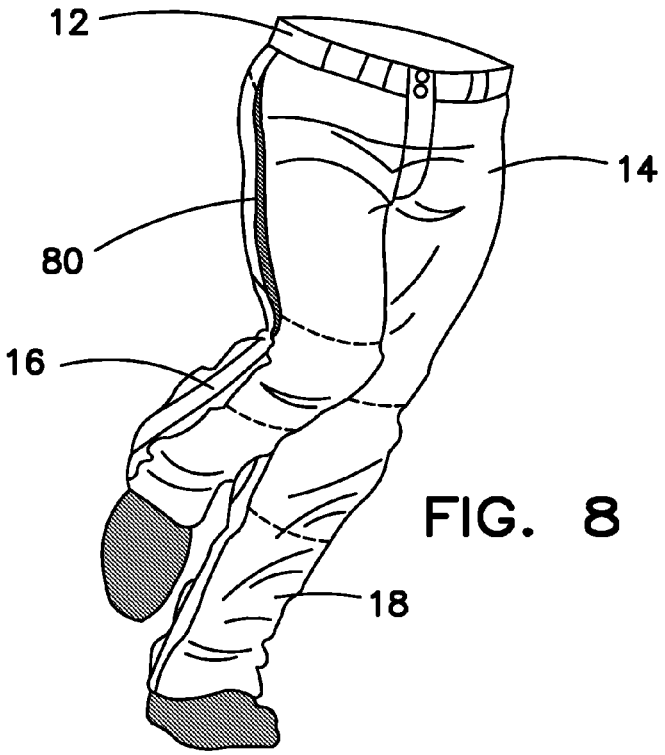
FIG. 8 shows a perspective view of the athletic pants of FIG. 5.

The slit 70 shown in the embodiment of FIGS. 1-4 is between about twelve and six inches in width (in the direction of arrow 24 in FIG. 1), and generally about 10 inches in width for a regular sized adult pant 10. The width of the slit generally extends from the outer longitudinal seam 54 to the inner longitudinal seam 56 in the embodiment of FIGS. 1-4. In other embodiments, the width of the slit may be shorter than or longer than the distance between the seams 54, 56. The slit 70 shown in the embodiment of FIGS. 1-3 is between about 0.5 inches and 2.0 inches in height (in the direction of arrow 26 in FIG. 1) near the center of the slit (i.e., at the middle of the knee portion 64). The height of the slit 70 generally extends between upper arched portion 72 and lower arched portion 74. In at least one embodiment, the height of the slit is about 1.25 inches. While the slit has been disclosed in terms of certain positions, sizes and shapes on the knee portion, it will be recognized that the position, size and shape of the slit may be different from that disclosed herein in other alternative embodiments.

A second material 32 different from the first material 30 is provided in the slit 70. In at least one embodiment, the second material 32 is sewn in place in the slit using stitching along the seam of the slit. The second material 32 is a durable material that has a substantially greater elasticity than the first material 30. This allows the second material 32 to resiliently stretch substantially more than the first material 30. In one embodiment, the second material may stretch substantially more than the first material in both a horizontal and a vertical direction. Accordingly, the second material may be a fabric comprised of a substantial percentage of elastomeric fibers (e.g., greater than 10% elastomeric fibers). A common example of an elastomeric fiber used in textiles is spandex (also known as "elastine").

In at least one embodiment, the second material is comprised of about 15% spandex. Because of this significant percentage of spandex in the second material, the second material is capable of a significant amount of stretching in both the longitudinal and latitudinal directions. By contrast, the first material which includes little or no spandex or other elastomeric fibers is capable of very little stretch in either the latitudinal or longitudinal directions. Thus, because the first material is comprised of little or no spandex, while the second material is comprised of about 15% spandex, a great difference in stretch and flexibility is realized between the first material and the second material.

The second material adds stretch and flexibility to the athletic pants 10. In particular, the insertion of the second material at the knee portion allows the pant to expand and stretch in multiple directions. This creates mobility and movement not found in other specialty athletic pants, and specifically in baseball pants. These expanding and stretching characteristics may add comfort to the user when running, crouching, sliding or performing other athletic activities. The second material may also be of a contrasting color to that of the first material to add ornamental features to the pants.

An alternative embodiment of the athletic pants is shown in FIGS. 5-8. In this embodiment, the opening is a vertical slit provided as a lateral thigh portion 80. The lateral thigh portion 80 runs lengthwise (i.e., in a vertical direction) along the outside of each pant leg and extends the approximate length of the vastus lateralis of an athlete wearing the pants. Accordingly, the lateral thigh portion 80 is considered to extend across the vastus lateralis portion of the pants 10. In the embodiment shown in FIGS. 5-8, the lateral thigh portion 80 is provided along the outer seam 54 on the upper portion 60 of each leg 16, 18, and extends from the hip portion 14 to the knee portion 64 of the pants 10. The lateral thigh portion 80 is generally about six inches to about twenty-four inches in height (in the direction of arrow 26 in FIG. 1) and about one half inch to three inches in width (in the direction of arrow 24 in FIG. 1). In the embodiment shown in FIGS. 5-8, the lateral thigh portion 80 is about sixteen inches in height and about 1 inch in width. While the lateral thigh portion 80 generally extends from the hip portion 14 to the knee portion 64, the lateral thigh portion 80 may also extend to a further extent, such as from the waist portion 12 to the lower leg portion 62.

As with the embodiment of FIGS. 1-4, the second material 32 provided in the slit 80 is different from the first material 30 that makes up the substantial remaining portion of the pants. The second material 32 is a durable material that has a substantially greater elasticity than the first material 30. This allows the second material 32 to resiliently stretch substantially more than the first material 30. In one embodiment, the second material may stretch substantially more than the first material in both a horizontal and a vertical direction. Accordingly, the second material is comprised of a substantial percentage of elastomeric fibers (e.g., greater than 10% elastomeric fibers), while the first material contains no elastomeric fibers or contains a small percentage of elastomeric fibers (e.g., 5% or less). A common example of an elastomeric fiber used in textiles is spandex (also known as "elastine").

In at least one embodiment, the second material is comprised of about 15% spandex. Because of this significant percentage of spandex in the second material, the second material is capable of a significant amount of stretching in both the longitudinal and latitudinal directions. By contrast, the first material which includes little or no spandex or other elastomeric fibers is capable of very little stretch in either the latitudinal or longitudinal directions. Thus, because the first material is comprised of little or no spandex, while the second material is comprised of about 15% spandex, a great difference in stretch and flexibility is realized between the first material and the second material.

The second material in the lateral thigh portion 80 of FIGS. 5-8 adds stretch and flexibility to the athletic pants 10. In particular, the insertion of the second material at the lateral thigh portion 80 allows the pant to expand and stretch in multiple directions. This creates mobility and movement not found in other specialty athletic pants, and specifically in baseball pants. These expanding and stretching characteristics may add comfort to the user when running, crouching, sliding or performing other athletic activities.

Figure 9:
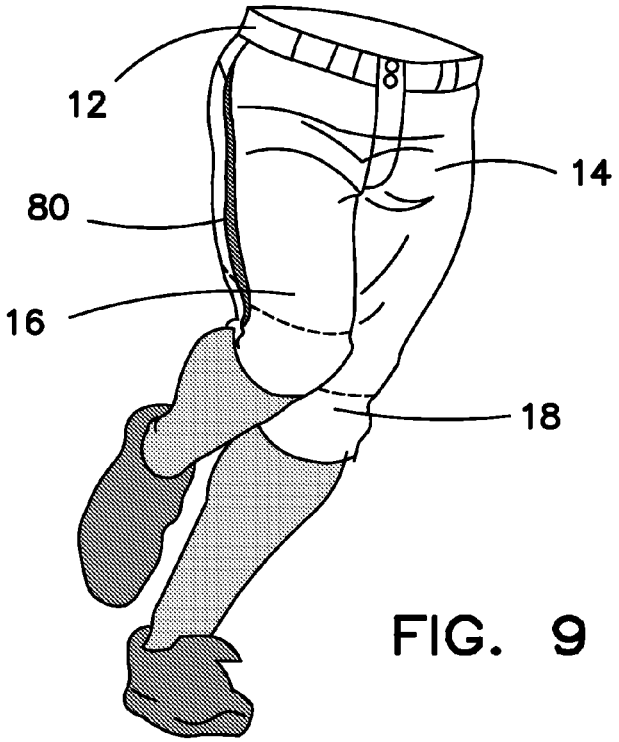
FIG. 9 shows a perspective view of an alternative embodiment of the athletic pants of FIG. 5.

Another alternative embodiment of the athletic pants 10 is shown in FIG. 9. In this embodiment, the athletic pants include the lateral thigh portion, but are shorter pants such that the legs of the pants end below the knee portion and do not extend to the ankles.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. Athletic pants configured to be worn by a wearer, the athletic pants comprising:

a hip portion configured to cover a buttocks of the wearer, the hip portion comprised of a first material;

two leg portions extending from the hip portion and also comprised of the first material, each leg portion including a front panel and a rear panel joined together along a left seam and a right seam, each front panel including a knee portion configured to be worn over the knee of the wearer, each leg portion configured to flex at the knee portion between a straight position and a bent position;

an opening formed in each knee portion between the left seam and the right seam of each front panel with a second material provided in each opening, wherein the second material has greater elasticity than the first material, each opening having a lens shape defined by an upper arched perimeter portion and a lower arched perimeter portion, the upper arched perimeter portion and the lower arched perimeter portion meeting at two opposing ends of the opening, wherein the upper arched perimeter portion is separated from the lower arched perimeter portion by at least 0.5 inch and no more than 2 inches when the leg portion is in the straight position and when the leg portion is in the bent position, and wherein the distance between the two opposing ends of the opening is at least 6 inches and no more than 12 inches.

2. The athletic pants of claim 1 wherein the first material is a fabric comprising 5% or less elastomeric fibers and the second material is a fabric comprising at least 10% elastomeric fibers.

3. The athletic pants of claim 2 wherein the elastomeric material is spandex.

4. The athletic pants of claim 1 wherein the ends of the upper arched perimeter portion are connected to the ends of the lower arched perimeter portion at the two opposing ends with remaining portions of the upper arched portion and the lower arched perimeter portion remaining separate when the second material is both stretched and unstretched.

5. The athletic pants of claim 4 wherein each knee portion is in the shape of a symmetric lens.

6. The athletic pants of claim 1 wherein the athletic pants are baseball pants.

7. The athletic pants of claim 1 wherein the distance separating the upper arched perimeter portion from the lower arched perimeter portion is about 1.25 inches between a central span of the upper arched perimeter portion and a central span of the lower arched perimeter portion.

8. Baseball pants comprising:

a waistband;

a hip portion configured to cover a buttocks of a wearer, the hip portion comprised of a first material;

two leg portions extending from the hip portion, each leg portion including a front panel comprised of the first material and a rear panel comprised of the first material, the front panel and the rear panel being joined together along a left seam and a right seam;

a knee slit formed in the front panel, the knee slit extending from the left seam to the right seam with a second material provided in the knee slit, the second material having a greater elasticity than the first material, the front panel configured to be selectively positioned in a straight position with the second material not stretched or in an bent position with the second material stretched, the knee slit providing an opening in the front panel that extends from the left seam to the right seam, the opening greater in width than in height and exposing a width of at least 6 inches and a height of at least 0.5 inch of the second material when the front panel is in the straight position and in the bent position; and a tapered end provided at a distal end of each leg portion.

9. The baseball pants of claim 8 wherein each knee slit is in the shape of a lens.

10. The baseball pants of claim 9 wherein each knee slit is in the shape of a symmetric lens defined by an upper arched perimeter portion and a lower arched perimeter portion.

11. The baseball pants of claim 8 wherein the first material is a double-knit polyester material comprising less than 5% elastomeric fibers and the second material comprises less than 10% elastomeric material.

12. Athletic pants comprising:

a hip portion configured to cover a buttocks of a wearer;

a leg portion including an upper portion and a lower portion with a knee portion positioned between the upper portion and the lower portion, the leg configured to flex at the knee portion between a straight position and a bent position;

the upper portion and the lower portion of the leg and the hip portion are comprised of a first material; and the knee portion comprised of a second material configured to stretch substantially more than the first material, wherein the knee portion is provided as an area on the pant that is elongated in the horizontal direction, wherein the knee portion is provided within an opening in the leg that is void of the first material, and wherein a height of at least 0.5 inch and less than 2 inches of the second material and a width of at least 6 inches and less than 12 inches of the second material is exposed in the opening when the knee portion is in the straight position and in the bent position.

13. The athletic pants of claim 12 wherein the knee portion is lens shaped and includes an upper arched perimeter portion and a lower arched perimeter portion.

14. The athletic pants of claim 13 wherein ends of the upper arched perimeter portion are connected to ends of the lower arched perimeter portion.

15. The athletic pants of claim 14 wherein the opening is in the shape of a symmetric lens.

16. The athletic pants of claim 12 wherein the first material is a fabric comprising less than 5% elastomeric fibers and the second material is a fabric comprising at least 10% elastomeric fibers.

17. The athletic pants of claim 12 wherein the knee portion is exposed on the pant when the second material is stretched and when the second material is not stretched.

18. The athletic pants of claim 12 wherein between 0.5 and 2.0 inches of the second material is exposed in the opening when the leg is in the straight position and in the bent position.

19. The athletic pants of claim 12 wherein about 1.25 inches of the second material is exposed in the opening in the vertical direction when the leg is in the straight position and in the bent position.

* * * * *